US005479902A

United States Patent [19]

Wirbeleit et al.

[11] Patent Number: 5,479,902

[45] Date of Patent: Jan. 2, 1996

[54] FUEL INJECTION SYSTEM FOR A DIESEL ENGINE

[75] Inventors: Friedrich Wirbeleit; Wolfgang Lehner, both of Esslingen; Alois Raab, Aalen, all of Germany

[73] Assignee: Daimler-Benz AG, Stuttgart, Germany

[21] Appl. No.: 283,954

[22] Filed: Aug. 2, 1994

[30] Foreign Application Priority Data

Aug. 2, 1993 [DE] Germany ..... 43 25 904.9

[51] Int. Cl.[6] ..... F02M 37/04

[52] U.S. Cl. ..... 123/498; 123/472

[58] Field of Search ..... 123/498, 499, 123/497, 357, 472

[56] References Cited

U.S. PATENT DOCUMENTS

| | | | |
|---|---|---|---|
| 4,718,386 | 1/1988 | Gieles | 123/472 |
| 4,725,002 | 2/1988 | Trachle . | |
| 4,750,706 | 6/1988 | Schlagmüller . | |
| 4,779,596 | 10/1988 | Babitzka | 123/472 |
| 5,169,067 | 12/1992 | Matsusaka . | |

FOREIGN PATENT DOCUMENTS

| | | | |
|---|---|---|---|
| 0303589 | 2/1989 | European Pat. Off. . | |
| 0431272 | 6/1991 | European Pat. Off. . | |
| 2343285 | 3/1975 | Germany . | |
| 2527854 | 1/1976 | Germany . | |
| 2931874 | 2/1981 | Germany . | |
| 3533085 | 3/1987 | Germany . | |
| 4006488 | 9/1991 | Germany . | |
| 0147143 | 6/1989 | Japan | 123/498 |
| 2082251 | 3/1982 | United Kingdom | 123/498 |

OTHER PUBLICATIONS

Technische Rundrchau 41, 1992, "Piezopower" p. 38

*Primary Examiner*—Carl S. Miller
*Attorney, Agent, or Firm*—Klaus J. Bach

[57] ABSTRACT

In a fuel injection system for a Diesel engine with a high pressure fuel pump supplying fuel under pressure to a common high pressure fuel supply conduit from which the fuel is admitted to a number of fuel injectors having fuel injection control needles engaged by springs so as to be normally seated on a valve seat and a control needle actuator for lifting the control needle off the valve seat under the control of an electronic control unit, the needle includes a cylindrical needle body movable within a cylinder and has slot-shaped orifices formed in its outer surface which are fully covered when the control needle is seated but which are exposed to a degree controllable by the needle actuator for adjustment of the orifice sizes depending on engine operating parameters.

6 Claims, 1 Drawing Sheet

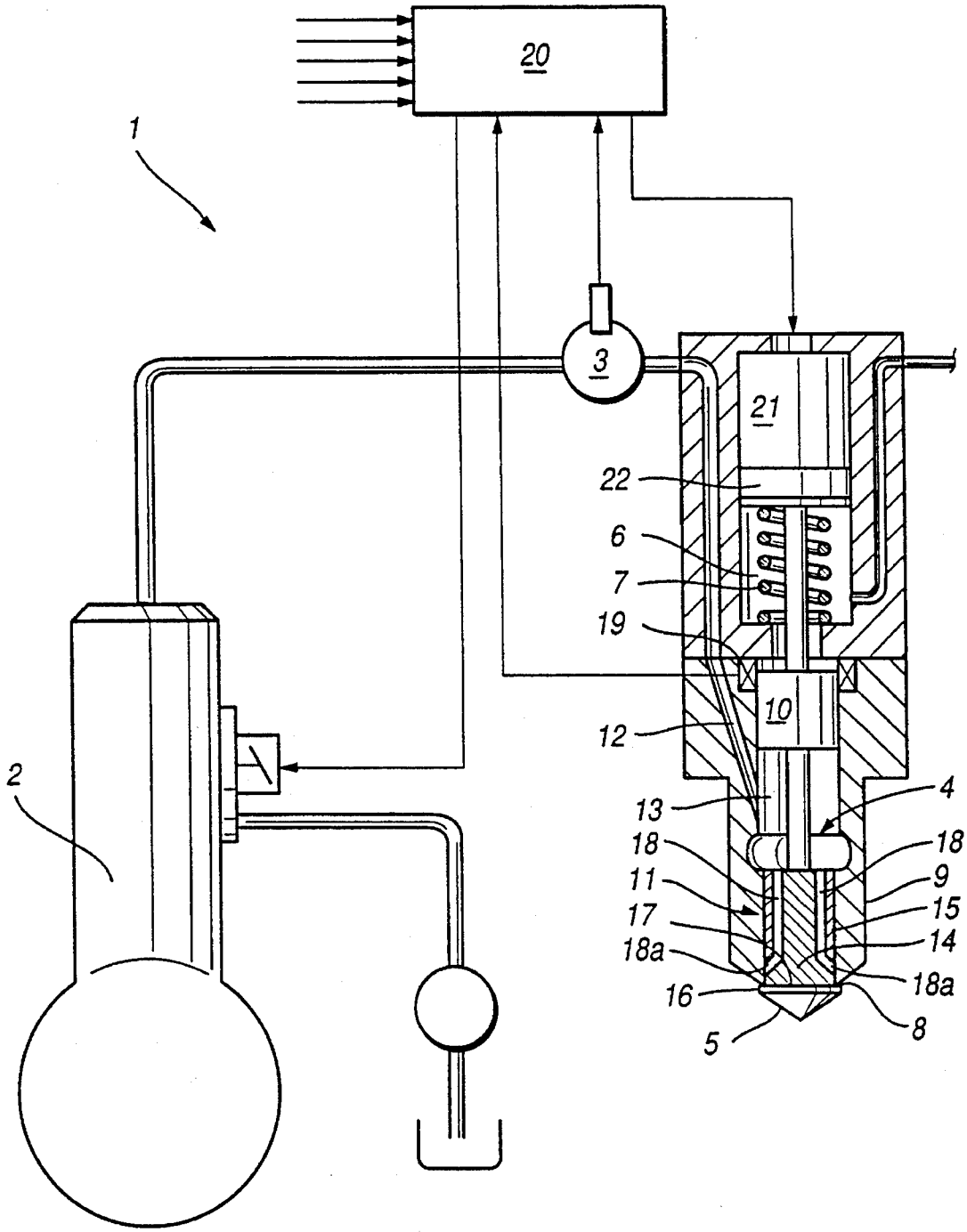
20
1
3
21
22
6
7
19
10
12
2
13
4
18
18
11
9
17
15
18a
14
16
18a
5
8

FUEL INJECTION SYSTEM FOR A DIESEL ENGINE

BACKGROUND OF THE INVENTION

The invention relates to a fuel injection system for a Diesel engine which includes a high pressure fuel pump supplying fuel under pressure to a common-rail fuel supply conduit which is in communication with valve-controlled injectors fop the injection of fuel under the control of an electronic control unit.

Such a fuel injection system with a high pressure pump and a common supply conduit for all injectors and control elements which can be activated to cause opening of the injector needle valve is known from the publication ATZ/MTZ special edition Motor and Environment '92 "Electronic Controlled Fuel Injection System for Clean Diesel Engine", pages 28–30 by Toshihiko Omari: As control element an electromagnet is used for operating a 3-way valve which normally provides for high pressure communication between the supply conduit and the backside of the injector needle of an injector with a bore type injection orifice but which, in operative position with activated control element, provides for pressure relief communication between the backside of the injector needle and a fuel discharge conduit to permit opening of the injector needle.

With such so-called Common-Rail-System fuel injection arrangements the fuel pressure level which can be freely chosen affects directly the injection time. An excessively high injection pressure will, with small injection amounts, necessarily result in short injection times which however is not desirable and even problematic with today's powerful, and especially with highly charged, direct-injection Diesel engines.

It is therefore the object of the present invention to provide a fuel injection system of the type referred to above, wherein the injection time can be selected over the whole engine performance range for each individual load point independently of the level of the fuel injection pressure.

SUMMARY OF THE INVENTION

In a fuel injection system for a Diesel engine with a high pressure fuel pump supplying fuel under pressure to a common high pressure fuel supply conduit from which the fuel is admitted to a number of fuel injectors having fuel injection control needles engaged by springs so as to be normally seated on a valve seat and a control needle actuator for lifting the control needle off the valve seat under the control of an electronic control unit, the needle includes a cylindrical needle body movable within a cylinder and has slot-shaped orifices formed in its outer surface which are fully covered when the control needle is seated but which are exposed to a degree controllable by the needle actuator for adjustment of the orifice sizes depending on engine operating parameters.

Since, with this arrangement, the injection orifice cross-section of the injector is variable and can be controlled depending on the requirements, the injection time can be adjusted independently of the fuel injection pressure over the whole engine performance range. As a result of the particular arrangement of the pressure compensation piston with the slot-like injection orifice, the orifice can be opened independently of the fuel pressure solely against the closing force of the spring provided in the injector.

Opening of the slot-injection orifices can be controlled by energizing a piezo actuator which acts on the injector needle by way of a hydraulic transmission element against a compression spring with a voltage-dependent force. A needle lift sensor which cooperates with the pressure compensation piston determines the momentary lift position of the orifice needle and corresponding signals are supplied to an electronic control unit which constantly compares the actual injector needle position with a desired position given in performance graphs. In this manner, the desired injector orifice cross-section can be obtained by way of voltage control of the piezo actuator.

It is particularly advantageous to use a magnetostrictive actuator for the controlled opening of the injector orifice in place of a piezo actuator since it requires substantially lower electrical voltages than are necessary for operating a piezo actuator.

BRIEF DESCRIPTION OF THE DRAWINGS

The sole FIGURE shows a fuel injection system with a fuel injector shown in a cross-sectional view.

DESCRIPTION OF A PREFERRED EMBODIMENT

As shown in the FIGURE a fuel injection system for a Diesel engine comprises a cam-operated high pressure pump 2 and a fuel injection conduit structure with a common supply conduit 3 for all injectors.

Each injector includes a slot orifice 4 with an injector orifice control needle 5 which is movable outwardly for opening the orifice and which is forced onto the valve seat 8 on the injector body 9 by means of a return spring 7 disposed in the spring chamber 6. The orifice control needle 5 includes a pressure compensation piston 10 which, with the needle tip 11, delimits a pressure chamber 13 which is in communication with the common supply conduit 3 by way of a fuel admission passage 12.

The piston-like needle tip 11 comprises a main grooved body 14 and a guide sleeve 15 which is mounted on the grooved body 14 and movable therewith and further a collar 16 which is disposed outside the injector body 9 and has a rear side 17 which forms the valve seating surface. The grooved body 14 has, at its circumference, at least two grooves 18 which extend from the pressure chamber parallel to the longitudinal axis of the needle and, at the bottom, have inclined end walls extending to the outer circumference of the grooved body such that an oblong opening **18*a* is formed between the lower edge of the guide sleeve 15 and the inclined end wall 18*a* of the groove 18. However, it is pointed out that the body 14 may be free of any grooves and the grooves may be provided in the guide sleeve 15** to form the fuel injector passages.

The pressure compensation piston 10 is surrounded by a needle position sensor 19 which continually senses the position of the orifice control needle 5 and whose signals are entered into an electronic control unit 20.

At the rear end of the orifice control needle 5 opposite its tip 11 there is a magnetostrictive actuator 21 which is addressed by the control unit 20 and which operates the orifice control needle 5 by way of a hydraulic transmission element 22 which is not shown in detail. Instead of the magnetostrictive actuator, a piezo actuator may be utilized. Also, as a transmission element one with elastomer or with mechanical force transmission can be utilized.

The electronic control unit 20 which receives the engine operating parameters such as rotational speed, load, charge air temperature and similar data, constantly compares the actual needle lift position with desired values present in a performance graph. An appropriate injector slot orifice cross-section 18*a* of the grooves 18 is maintained by way of voltage control of the actuator 21. At the end of the injection period energization of the actuator 21 is interrupted so that the orifice control needle is returned by the return spring 7 to a rest position in which the needle tip 11 is seated on the valve seat 8.

It is pointed out that with the injector described herein the orifice cross-section of the fuel injector can be controlled so that, with a particular fuel supply pressure and a particular quantity of fuel to be injected, the injection time is adjustable depending on engine operating parameters.

What is claimed is:

1. A fuel injection system for a Diesel engine comprising a common high pressure fuel supply conduit (Common Rail), a high pressure fuel pump supplying fuel under pressure to said fuel supply conduit, a number of valve-controlled injectors in communication with said fuel supply conduit so as to receive fuel under pressure therefrom, each injector including a body with a control needle movably disposed therein and having a valve seat and a spring engaging the control needle so as to be normally seated on said valve seat and a needle actuator for lifting said needle of its seated position under the control of an electronic control unit, said needle including a piston-like tip with slot-shaped orifices formed in the outer surface thereof which orifices are fully covered when said control needle is seated but are exposed as said control needle is unseated by said needle actuator, said control needle including a pressure compensation piston disposed in a cylinder formed in said injector body and defining in said injector body with said piston-like needle tip a pressure chamber in communication with said fuel supply conduit for compensating the fuel pressure effective on said control needle so that the effective cross-section of the orifice opening of said injector is controlled solely by said needle actuator.

2. A fuel injection system according to claim 1, wherein said needle actuator is a piezo actuator arranged at the end of said control needle opposite said needle tip.

3. A fuel injection system according to claim 1, wherein said needle actuator is a magnetostrictive actuator arranged at the end of said control needle opposite said needle tip.

4. A fuel injection system according to claim 1, wherein a hydraulic force transmission structure is arranged between said needle actuator and said control needle.

5. A fuel injection system according to claim 1, wherein said injector body includes a control needle position sensor disposed adjacent said pressure compensation piston for sensing its axial position within said cylinder.

6. A fuel injection system according to claim 1, wherein said needle tip includes a body with grooved outer surface and a sleeve disposed around its grooved outer surface and defining the axial lengths of said control needle orifices, said sleeve being axially movable in said injector body with said control needle.

* * * * *